US005486001A

United States Patent [19]

Baker

[11] Patent Number: 5,486,001

[45] Date of Patent: Jan. 23, 1996

[54] PERSONALIZED INSTRUCTIONAL AID

[76] Inventor: Rick Baker, 10 Dundee Court, Robina Woods Queensland 4226, Australia

[21] Appl. No.: 146,016

[22] PCT Filed: Jun. 1, 1992

[86] PCT No.: PCT/AU92/00253

§ 371 Date: Apr. 21, 1994

§ 102(e) Date: Apr. 21, 1994

[87] PCT Pub. No.: WO92/21412

PCT Pub. Date: Dec. 10, 1992

[30] Foreign Application Priority Data

May 30, 1991 [AU] Australia ..... PK6405

[51] Int. Cl.[6] ..... A63B 69/36

[52] U.S. Cl. ..... 273/183.1; 273/186.1; 434/252

[58] Field of Search ..... 273/35 R, 183.1, 273/185 A, 186.1; 434/247, 249, 252

[56] References Cited

U.S. PATENT DOCUMENTS

| | | | |
|---|---|---|---|
| 3,408,750 | 11/1968 | McCollough . | |
| 4,137,566 | 1/1979 | Haas . | |
| 4,304,406 | 12/1981 | Cromarty | 273/186 R |
| 4,337,049 | 6/1982 | Connelly | 434/247 |
| 4,508,510 | 4/1985 | Clifford | 434/247 |
| 4,852,184 | 7/1989 | Tamura . | |
| 4,891,748 | 1/1990 | Mann | 273/183.1 X |
| 4,893,182 | 1/1990 | Gautraud et al. | 358/105 |
| 4,941,660 | 7/1990 | Winn et al. | 434/247 X |
| 4,942,391 | 7/1990 | Kikuta . | |
| 5,056,791 | 10/1991 | Poillon et al. | 273/185 B |
| 5,184,295 | 2/1993 | Mann | 364/410 |
| 5,249,967 | 10/1993 | O'Leary et al. | 434/247 |
| 5,297,796 | 3/1994 | Peterson | 273/183.1 |

FOREIGN PATENT DOCUMENTS

| | | |
|---|---|---|
| 0312180 | 1/1991 | Japan . |
| 0326281 | 2/1991 | Japan . |
| WO8807735 | 10/1988 | WIPO . |
| 89056750 | 1/1989 | WIPO . |

*Primary Examiner*—Jessica J. Harrison
*Attorney, Agent, or Firm*—Richard C. Litman

[57] ABSTRACT

An instructional aid (10) for enabling and assisting a person to emulate a predetermined movement such as a golf swing including an image/data capturing device (11) for scanning, capturing and storing the image/data signals of the person's golf swing or movement, and a transceiver (14) for transmitting the image/data signals over a communications network (15) to a remote computer (17). The computer (16) contains a database (17) which stores in digital form image signals and bio-mechanical data of a number of preselected swing or movements. The computer (16) analyzes the person's image/data signals against image/data of a preselected swing and generates in digital form further visual images/data signals which can be transformed so as to assist or enable a person to be able to emulate the preferred swing. The instructional aid may also be used for analyzing or reporting on particular geographical regions or objects and provides a specialized presentation for development of that region or object from information stored in the computer database.

20 Claims, 2 Drawing Sheets

PERSONALIZED INSTRUCTIONAL AID

BACKGROUND OF THE INVENTION

1. Field of the Invention

This invention relates to a method and apparatus means for providing an expert knowledge base in an instructional aid which in one aspect may be used as a teaching aid, and in particular as a teaching aid for teaching of movements and techniques, such as used in sports for the game of golf. The present invention, however, is applicable to other movements, sports, pastimes or techniques.

In a further aspect the present invention relates to a method and apparatus means for providing an expert visual or audio-visual assessment of a particular proposal relating to geographical locations. One such application is to generate a visual display of a particular tract of land for a golf course layout made up from a number of pre-stored hole designs or computer generated hole designs which have taken into account all aspects of the final layout design on the overall development, with the inclusion of audio or audio-visual data pertaining to structural methods for success.

The present invention has further application in providing an assessment on a particular object by, for example, comparing properties of that object with those of a preferred object.

2. Description of Background Art

As golf has become an increasingly popular pastime over the years, many players wishing to improve their own personal techniques, have pursued professional assistance. Often players, be they professionals or amateurs, may wish to emulate successful movements of top players or coaches who are exposed in the mass media. At the present time, these players have a number of choices available to them in attempting to try to emulate such movements, which may include either general practice, private coaching, viewing current audio-visual instruction tapes, recording their own personal movements and analyzing same, or studying photographs, slides, etc. of their swing in action.

In all the above cases, the onus is placed upon the individual or coach, to perceive those areas of movement that differ between the current technique of the player and that of the preferred technique they are trying to achieve. Even for a specialized person working in their own chosen sport or profession, such differences in movement can be so minute or hard to detect, for example, a person's weight shift or pressure in their grip or arms, that they can go undetected and so handicap that person's potential rate of improvement. The reason for this particularly in the above instructional visual teaching cases is that the viewer watches information flowing to him in one direction only regarding the current or preferred technique. Thus, the viewer cannot perceive all aspects of the movement because of no corresponding physical forces or certain performance data to relate specifically with. Such visual presentations do not show their current technique along with the preferred technique with the addition of bio-mechanical information. Also, in the use of current general prerecorded instructional audio visual presentations they direct their information towards a mass audience as a whole without any allowance for a person's particular technique or requirement of individual problem solving.

In other situations where conceptual instructional advice is required, the quality of advice can vary, for example, when a person is considering whether or how to best construct a particular tract of land he owns or is considering acquiring. For example, for the development or remodelling of a golf course, normally expensive preliminary surveying, design and feasibility works are carried out, to which he is reliant on all aspects of the development being expertly covered, which is not always the case. Similarly, if alternative ventures in particular areas are proposed, no audio-visual means are presently available which provides a customized or personalized completely regenerated, expertly compiled computer analysis in the visual or audio-visual form of potential works.

SUMMARY OF THE INVENTION

The present invention aims to provide in one aspect an expertly analyzed instructional aid employing visual or audio-visual techniques which allows for a flow of information in both directions; for example, between selected coaches and pupils so as to help that pupil or viewer improve his or her personal movements and techniques more quickly and without as much guesswork on his or her part.

The present invention also provides a method and means for teaching or instructing such movements or techniques in precise ways, that enables a person or mechanism to more clearly emulate another movement. While the present invention is particularly suited in one application to sports coaching, it may also be applied to other areas where an emulation of a precise movement or procedure is required, as will become more apparent from the following operating description. The present invention may additionally be applied to providing expertly compiled opinion in the form of a visual or audio-visual overview of a particular geographical location altered in accordance with selected criteria.

With the above, and other objects in view, the present invention provides in a first preferred aspect, a method for providing an instructional aid for assisting a person to emulate a preferred movement including the steps of capturing and storing visual image signals representative of a particular movement, comparing said captured image signals with stored image signals representative of a selected preferred movement, and regenerating further visual image signals based on said image signals of said particular movement, adjusted to emulate said stored image signals of said selected movement.

In a second aspect, the present invention provides apparatus for providing an instructional aid for assisting a person personally to emulate a preferred movement or technique, said apparatus including means for capturing visual image signals of a particular movement or technique, means for storing said captured visual image signals, means for storing visual image signals of a plurality of preferred movements or techniques, means for comparing said captured visual image signals with the stored image signals of a selected said preferred movement or technique, and means for regenerating further visual image signals of said particular movement or technique adjusted in accordance with said selected preferred movement or technique to assist a person to emulate said selected preferred movement or technique. The term "image signals" as used herein includes signals representative of such images such as digital information which can be converted into visual images.

Preferably the visual images of the particular movement are captured and stored in digital form using known video recording techniques such as with a video camera which produces a video cassette containing the images of said particular movement. Alternatively, other means may be provided for capturing and storing the visual images as described further below. The visual images of the preferred movements are preferably stored in digital form in a data base of a computer so that a selected preferred movement can be readily accessed. The computer is most preferably located at a remote location so as to be accessible from a number of different locations.

Preferably means are provided to transmit the captured images in digital form for receipt by the computer. The transmitting means preferably transmits the images over the normal telephone network; however, other communications links may be employed.

The comparison in the computer can be carried out using either software techniques or hardware techniques and various sampling procedures. The computer is also preferably software or hardware programmed to take into account the size of the player and other physical characteristics such as length of arm so that a compensation factor may be included, whereby the movements such as swings of the player and the preprogrammed stored movements or swings in the computer can be truly compared. This comparison can take place at different times or positions in, for example, a swing to produce signals representative of the differences between the swings. This comparison signal may comprise a measurement of distance, angle, speed of swing or other parameters. Such signals may then be employed in regenerating the new visual image which approximates the captured image altered to emulate the preferred image.

While the invention described within has particular applications to teachings in sport, so as to help and assist a person emulate a particular movement or technique, it may also be applied to many other situations and fields where an emulation or overview of a precise movement is required. Thus, the invention may be applied to various applications in the art fields, for example, the teaching of dance steps or within the medical field where precise movements are required to be studied, and expert advice given such as with human body movements.

Additionally, the present invention may be applied to fields where expert systems appraisals and emulations of a development structure may be required such as in the property field for precise calculations and designs of future development proposals or where expert appraisal of a particular object is required by comparison with a preferred or ideal object.

The present invention thus provides in a further aspect a method of providing an instructional aid relating to a development proposal comprising the steps of capturing and storing visual image and location data signals of a proposed development location, analyzing said captured signals against the signals of a selected or preferred known development or means for forming a new design development, and regenerating further visual image and data signals based on said signals of said proposed development adjusted in accordance with said preferred development or said newly formed design development so as to provide a recommendation for said preferred development.

In a further aspect, the present invention provides apparatus for providing an instructional aid based on a visual image of a particular movement or location, said apparatus including means for visually scanning said movement or location and for producing visual image signals representative of said movement or location, means for storing said visual image signals, means for transmitting said visual image signals to a remote location, means for comparing said transmitted visual image signals with corresponding signals of a selected pre-stored image or images, means for regenerating further image signals comprising said image signals of said particular movement or location adjusted in accordance with said pre-stored signals of said image or images, and means for retransmitting said regenerated image signals and converting said image signals into a format which enables viewing thereof.

In yet a further aspect, the present invention provides apparatus for providing a personalized instructional aid in a development presentation based upon a visual image signal of a particular location, said apparatus including means for visually scanning said location and for producing image and informational data signals representative of said location, means for storing said visual and data signals, means for transmitting said visual and data signals to a remote location, means for comparing said visual and data signals with the signals of a selected pre-stored location and the structural procedure relating thereto visual and data signals, means for regenerating further visual and data signals based on said signals of said particular location adjusted in accordance with said pre-stored procedure signals to assist in said development, means for adding dialogue and information data to said regenerated signals, and means for transmitting said regenerated image and data signals and converting said signals into a format which enables viewing thereof.

In another aspect, the present invention provides apparatus for providing a personalized instructional aid based upon optical photometric characteristics of a selected target, said apparatus including means for visually scanning, sensing and capturing visual and data signals representative of said target, means for storing said visual and data signals, means for transmitting said visual and data signals to a remote location, means for comparing said visual and data signals with corresponding pre-stored signals of a selected target, means for regenerating further visual data signals comprising said signals of said particular target adjusted in accordance with said pre-stored preferred target signals, means for transmitting said regenerated image and data signals and converting said image signals into a format which enables viewing thereof.

Preferably the characteristics of the target which, for example, may be an object are sensed using imaging and non-imaging sensor systems. Preferably, also means are provided for adding dialogue or informational data to the regenerated format.

BRIEF DESCRIPTION OF THE DRAWINGS

Reference will now be made to the accompanying drawings which illustrate a preferred embodiment of the invention and wherein.

DETAILED DESCRIPTION OF THE PREFERRED EMBODIMENTS

Figure 1:
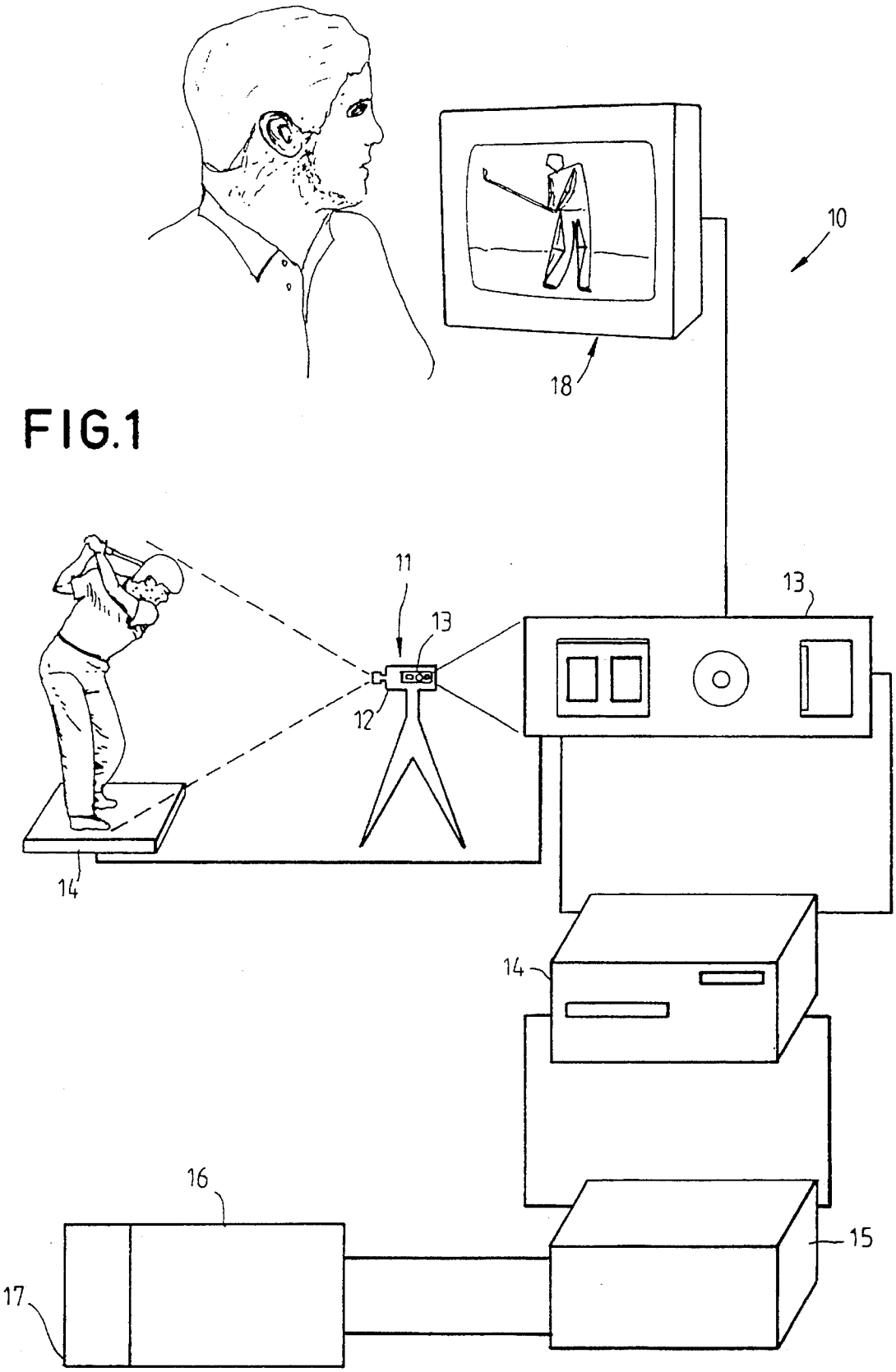
FIG. 1 illustrates in block diagram the instructional aid according to the present invention applied to the game of golf.
Figure 2:
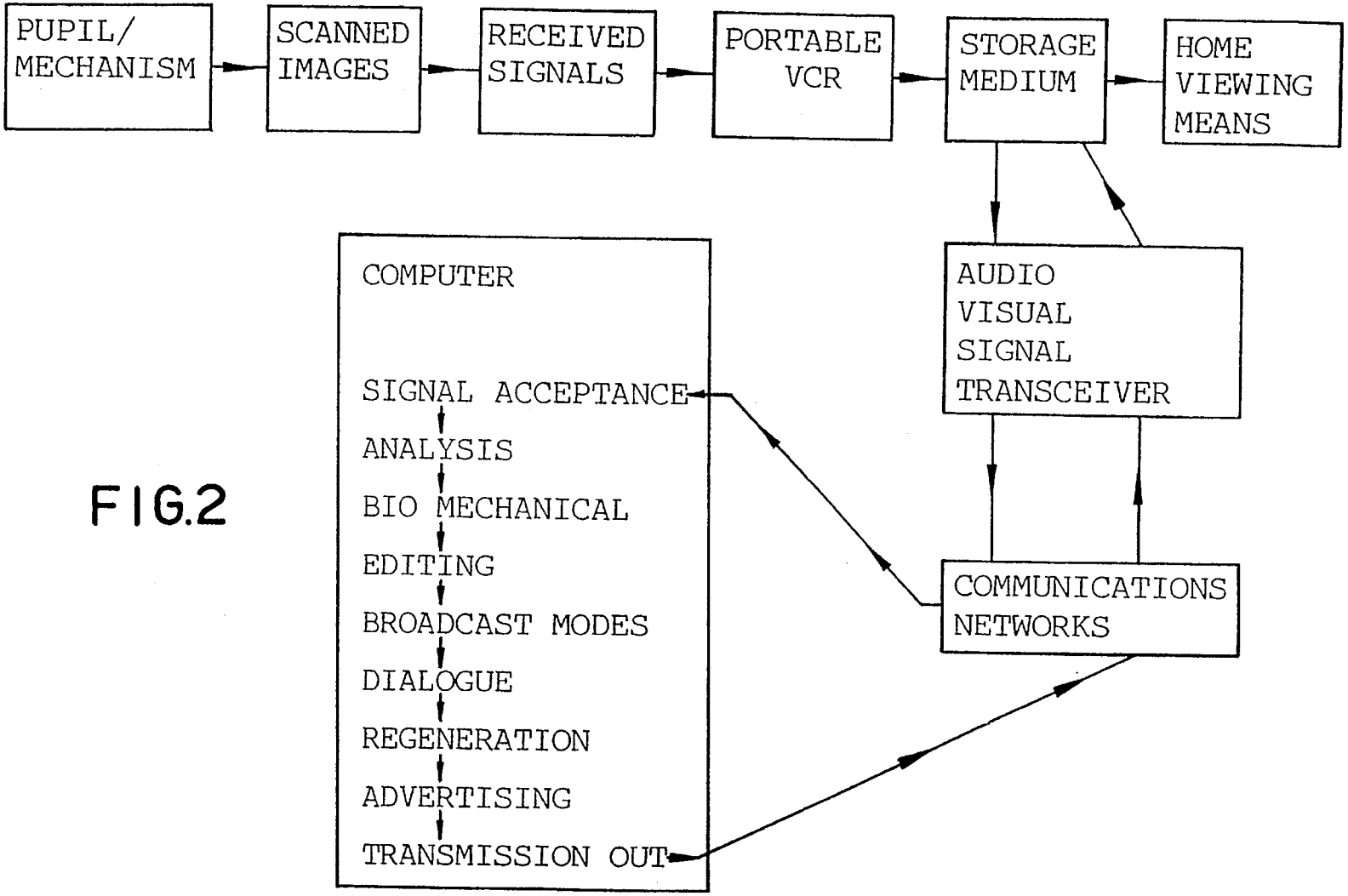
FIG. 2 is a flow chart showing the procedure involved in the invention.

FIG. 1 illustrates the apparatus for use in the present invention described below in reference to emulation of a golf swing, but usable in any situation where emulation of movement is required. The apparatus 10 includes a visual image capturing device 11 which is adapted to capture movement of the person undertaking a golf swing for subsequent analysis and correction as described below with reference to FIG. 1 and the flow chart of FIG. 2.

To capture the initial detailed visual images relating to physical characteristics including movement techniques employed during the golf swing, various scanning or electronic collecting procedures are used. For this purpose the image capturing device 11 preferably incorporates a portable electronic camera such as a video camera 12 or the like having an associated recording or signal storage means 13 as is known in the art to form and store signals representative of the characteristics of movements, etc. being viewed.

Where recording of movements takes place, bio-information data, may also be transmitted or collected upon the same storage means 13 contained within the framework of the portable video camera 12, so as to enhance further final specialized teaching or information features. Such bio-mechanical information data may be transmitted to the recording or storage means 13 by an electronic means, hard wiring or other communication means, either at the same time, as the captured visual signals relating to scanned images of the person being viewed or at a different time. In the embodiment illustrated, bio-mechanical information may be captured using a weight sensing pad or pads 14 which will sense weight transference during the swing.

The means used to collect and transmit such bio-mechanical information data, is at all times non- restrictive in its overall performance, so as to allow the pupil being analyzed to achieve normal free flowing movement without restriction. One such means may take the form of mechanical devices affixed or attached, to the person or golf club moved by the person so as to show data such as pressures transferred through the arms or hands, proper releasing techniques, velocities achieved, etc. Alternatively or additionally, sensing devices may be positioned alongside, below or above the person whose image is being captured. Such sensing devices as above may comprise weight or load sensitive pads, monitors, electronic light beaming devices or the like. Bio-mechanical, signals may also be obtained by various scanning, editing and digital techniques, used within a remote computer data base as described further below, once the signal has been received by the remote data base, to determine also the many characteristics of the person being studied.

The image capturing device 11 is preferably of portable construction, and of high recording quality, so as to scan, receive and store images and information data in broadcast quality. These visual or information signals are converted by sensors or the like into electrical charge patterns, etc., which are read out or scanned to produce digital electronic signals representative thereof, from electrical or light signals, produced by an electronic pick-up tube, charge-coupled device (CCD), or the like means within the camera framework, or by the information signalling devices referred to above.

For initially capturing the necessary signals for analysis, more than one image capturing device 11 may be used, so as to channel information regarding various visual details, information and data or the like, to one recording or storage medium. In this regard various switching techniques may also be used to switch between selected image capturing devices 11.

The signal storage or recording means may take the form of magnetic tape or disk, laser based or optical video disk, magneto-optic disk, magnetic-laser-optical disk or other storage medium. Alternatively, digitized signals representative of the scanned images or bio-mechanical and information data may be also transferred or stored onto a computer memory chip or the like, held within the camera framework.

The apparatus 10 also includes an audio-visual signal transceiver 14 adapted to receive and transmit audio-visual signals and other information signals in the manner described below.

The image capturing device 11 referred to above in one form is a unit discrete from the audio-visual signal transceiver 14 and adapted to be connected thereto or the two may be one and the same, so that the image capturing device 11 also incorporates a unit for transmission and reception of signals to and from remote data bases.

The audio-visual signal transceiver 14 may take the form of a portable signal unit or a personal computer (PC), which can convert, compress or suitably accept, a down-loading of captured signals, stored within the storage means 13 of the portable camera unit and then reform, record or store such signals in a suitable digital state for later transmission over a communications network 15. The communication network 15 may comprise the general switched telephone network, satellite links, television quality cable links or the like over which the signals representative of the person's movement together with bio-mechanical information where stored are directed as electrical or light signals to a remote computer 16 for storage in a computer data base 17 for later analysis against selected preferred signals also stored in a database of the computer or a another computer. As is conventional a modem or other similar signal conversion device may be associated with the computer 16 to receive the transmitter signals and convert those signals into a suitable form for reading by the computer 16. The modem or other similar signal conversion device may also be employed for transmission of signals from the computer 16 as described further below.

Initial capturing of audio, visual and data signal information, may also be undertaken using the audio-visual signal transceiver 14 (if not a personal computer) to which a video camera 12 may be directly connected so as to enable signals captured by the camera 12 to be recorded directly onto suitable storage medium held within the transceiver 14. The transceiver 14 is then able to transmit these captured signals to remote locations, when directly connected to the communications network described above. Thus, a single unit may perform all functions of recording, transmitting and receiving audio, visual and data signal information. The transceiver 14 for this purpose may include dual signal storage facilities, to achieve the above functions; however, the transceiver 14 may also be constructed so as to enable all functions of recording and playback in each mode within a single signal storage device.

This transceiver 14 is software and hardware programmed and may offer some of the following features:

1) The sender's details for later personalizing effects to the final video presentation, i.e., name and spoken language and means for selecting the person with whom the golf swing of the person is to be compared;

2) The transmitting party's or agent's details for account keeping purposes and security for the system, i.e., digitized security code;

3) Circuitry for increased transmission speed;

4) Circuitry and displays for showing details regarding signalling times to reach data base and regeneration times once retransmitted back to pupil's or agent's remote location, for account keeping purposes;

5) Circuitry and displays for showing the format of transmitted or requested signals in PAL, NTSC or SECAM, etc.;

6) Circuitry for time, date, automatic dial–redial, stop, start, receive, send, and possibly an advertising channel, etc.; and 7) Circuitry and displays for showing to whom the regenerated signals belong and to enable the retransmitted regenerated signal to be added to the already prerecorded signal, described below, if desired.

As stated above, the computer 16 is arranged normally at a remote location from the audio-visual transceiver 14 and includes a data base 17 which stores selected prerecorded video signals in digital form which in the case of golf swings may include a selection of swings showing the movement of different golf professionals which are required to be emulated. As the computer 16 and image capturing device 11 are not physically affixed or attached together, the computer 16 and data base 17 may be of a sufficient size and capacity to enable the desired functions to be achieved at one and the same location.

The computer 16 may be at many remote locations and holds within its database the following prerecorded information in digital form, which provide a basis for forming the regenerated audio-visual signals.

1) A digitized audio visual library of selected coaches, advisers, professional or mechanism (such as a golf simulation machine) movements, techniques, steps or procedures, that have been previously analyzed, recorded and reformed into suitable digitized signals, for later analysis and regeneration in the data base against the remote signals received.

2) A digitized bio-mechanical library of selected coaches or mechanism movements measured individually or as a group, for later display with the regenerated audio-visual signals.

The computer 16 incorporates a means for receiving and editing the transmitted visual data or bio-mechanical and information data signals, relating to the movement of the golfer, and arranges same in such a way as to be able to match the received visual signals with the previously established and selected data base signals of their preferred applications and generate a new video signal to enable the Viewer to see personally, in regenerated form, those differences that exist in: (a) a teaching mode, between the two movements, that of the pupil and the selected professional or coach; and (b) in an analysis mode, those ideas that might be possible for their preferred swings (or applications in development fields where the method and apparatus of the invention is used in this application). For this purpose, the computer is software and/or hardware programmed to compare the respective swings of the person being analyzed and the selected preferred swing with adjustments made such as for size of person, speed of swing and other parameters to allow a correct comparison. The differences between the swings are measured by sampling or other techniques and this difference added or subtracted from a person's recorded swing and new visual images generated on this basis which emulates the preferred movements.

The computer 16 may also include a means for adding dialogue to the regenerated audio visual signal recordings, so that the viewer can receive personalized instruction or advice from afar, similar to having private instruction or personal consultation.

The computer 16 may further include a means for converting received signals, if needed, in one broadcasting mode, into those of another countries, e.g., PAL, NTSC, SECAM, etc.. To accomplish this within the computer, a standards converter or the like may be used, using an optical scan or a digital standard features or the like.

The computer 16 may additionally include a means for determining the cost of each and every received and regenerated signal that passes through the system, based upon the following information:

(a) Signal transmission time to and from the computer.

(b) The amount of analysis and regeneration time required for each and every presentation, such as with the showing of audio-visual faults, bio-mechanical and characterized data graphs, dialogue, and broadcasting changes, etc..

The computer 16 is software and hardware programmed, to accept digitized signals transmitted to it, from remote locations, associated with the audio-visual transceiver 14, so as to personally relate in the final regeneration and editing phases to the viewer; this being performed by, using various digital editing techniques and procedures as described below.

The audio-visual presentation generated by the computer 16 can take the form of split-screening (generating new visual images of the preferred technique displayed alongside the present technique), superimposing (where the preferred technique is superimposed over the present technique) or other displays, graphics, charts, etc. for bio-mechanical and information displays, so that the viewer can clearly see those changes that are required or need to be performed, to develop or pursue the preferred movement, procedure or proposal. These superimposing effects or the like, may take the form of stick figures, detailed drawings, etc. of normal human or visual appearances, so as to show the viewer any variances between his stroke and the preferred stroke. For ease of editing the subject material within this computer data base, a time code or the like, maybe also burned into the original recorded signal, so as to make final editing much more efficient within the remote data base. This procedure may also be linked with an edit controller or the like, within the computer 16, which locks the two signals electronically together during editing.

To personalize the regenerated signal, dialogue is also added when required, so that the selected instructor or adviser may relate to the viewer or pupil more personally, than with other audio-visual presentations. Part of this personalizing effect is initially accomplished in the original transmission phase, by the name, spoken language, broadcasting mode or location statistics, etc. of the final viewer being captured within this data base to which an addition of dialogue can also be added when required in the regeneration signal phase, and showing those changes they need to perform or consider to obtain the preferred movement; thus, totally personalizing the new regenerated signal to the viewer.

For this purpose such dialogue, may only take the form of a brief statement, so as to make the viewer fully aware of those changes that are required, or need their consideration, to perfect the movement, procedure or development, etc..

The means for adding such dialogue may take the form of a voice energy monitor or the like, contained within the computer, which on analysis scans a memory bank of learned words or phrases to find suitable terms, to bring attention to these problem areas or matters needing their attention.

Dialogue may also be added relating to recommendations for the viewer's consideration in regards to suitability of equipment being used to perform the desired movements and techniques.

To increase acceptance as a true teaching aid, scientific data, which in many applications could only be assumed before, such as with personalized coaching, may be presented to a viewer, when needed, in the form of graphs, charts or the like, set either above, below, alongside or within the total regenerated video signal recording. This information is gathered from their received signals, being matched to their preferred established signals contained within the data base 17, so that the person or pupil can clearly see, those bio-mechanical differences that exist between, their current procedures or techniques and that of their selected coaches or professional's procedures or techniques.

Once the new audio-visual signal is regenerated, the signal is then retransmitted back by the computer 16 and via a modem or the like and the communications network 15 to the remote sender's or agent's transceiver 14. This procedure may be performed, from within the computer 16 itself, using various digital, compression and sampling techniques, or it can be again sent back by a further audio-visual transceiver associated with the computer 16.

On receipt at the remote pupil's or agent's receiving location, the regenerated signal may already be in suitable form, for direct saving on suitable storage means such as video tape, disk or the like which enables home viewing such as by means for a video cassette player and playback through a monitor 18. If not in a suitable form for direct saving, the signal may be reformed for storage as above on storage means which permits home viewing other than through a computer monitor by the use of either the receiving audio-visual transceiver, or by other suitable conventional means, offering various slowing down or speeding up signal procedures. If desired the regenerated audio-visual signal may be stored on the original storage means, e.g., video tape containing the player's current movements or techniques, or stored on a new storage means.

In the embodiment described and shown, the image capturing device 11 stores the captured images on a video cassette 19 of known form and the regenerated images are stored on the same cassette 19 or, alternatively, an additional cassette. The regenerated image in this embodiment is in the form of a stick FIG. 20 which is superimposed on the true visual image 21 (see FIG. 1) of the player's swing or movement, and which indicates to the player the angles and positions which he must adopt to emulate the swing.

To add further to this advanced audio-visual teaching aids' value, as a complete instructional system, compared to other audio-visual presentations, previously recorded instructional material, of a non-personalized nature, may also be added, to the final home storage presentation means such as a video cassette. Thus, this regenerated transmitted signal of the pupil's audio-visual presentation and data pertaining to movements, may be then simply added to the prerecorded material already held at the sender's or agent's remote location. In this format the single recording may then show: (a) an initial complete recorded procedure of instruction, as currently presented with audio-visual presentations; (b) an addition of their current movements, procedures or images etc. taken before regeneration; and (c) the final regenerated personalized audio-visual changes, that are required or affect the desired changes needed by the viewer.

A typical presentation with a preferred format and structure in the final video tape or other viewable means could be as follows:

Pupil: Mr. Rick Baker
Selected coach: Mr. Bobby Jones
Application for: Golf
Dialogue: English 1. Preferred audio-visual introduction:

"Hi, Rick, I am Bobby Jones. It is my pleasure to have studied your golf swing, and these are the points I feel you should be concentrating on."

2. Preferred audio-visual presentation in progress:

During the presentation while the pupil, Mr. Baker, is viewing the subject matter, the viewing monitor is showing segments of the previously recorded swing, taken at the recording facility, with superimposed preferred movements of Mr. Jones against Mr. Baker's current movements and pointing out with the addition of dialogue, those areas that he should be concentrating on, so as to improve his current technique. Bio-mechanical data in the form of graphs or charts, etc., are also added during the presentation, so that he and his local coach may also quite clearly see scientific data pertaining to those performed movements. Dialogue may also be added regarding suitability of equipment being used at this stage.

3. Towards the conclusion of this audio visual presentation, the coach could conclude by saying: "Thank you Rick for allowing me to help you improve your game, but please continue to work on these points with the help of your local professional, who is also there to assist you in overcoming these problems. Good golfing, this is Bobby Jones."

The above embodiment has been described with reference to a golf swing movement; however, as previously stated, the invention may readily be applied where other movements are required to be emulated. Such movement may comprise either movements of persons, movements of objects or mechanisms of which emulation is required.

In a further form the invention may be applied to the property field to enable professional assessments and presentations of designs for future development proposals or the like. In this form visual images and data relating to signals of a particular area of ground are captured using remote sensing techniques. For this purpose a camera and a remote sensing device may be fixed to the underside of an aircraft so as to capture and record geometrical or statistical information of the earth or objects featured beneath. Geographical data achieved through using this remote sensing as above may be computer coded or digitized using either video cameras, array scanners, laser beam, microwave or other means.

Information regarding the geographical area being scanned is then transmitted as before using a transceiver to a remote computer containing a data base of pre-stored expert information on attributes required of a particular area of land. Thus, where the best standard of golf course is required to be laid out upon a specific parcel of land, the data base may include a library of selected hole layouts from different courses. The computer which is software programmed may then select preferred hole layouts to match to the area of land of which geographical features has been scanned and recorded. Alternatively, the computer may itself design the appropriate hole layouts to best fit the area of land and proposed development. The computer data base may additionally include feasibility study means for determining and displaying measurements, costs and other procedures required to achieve the end result. The computer may further be programmed to take into account residential housing around the course and the location of same, so as to maximize the view of the course, etc..

As before, dialogue may be added to the regenerated audio-visual presentation as well as statistical graphs or other information relating to the development being studied.

The present invention may also be applied to enable a particular object to be analyzed against pre-stored data relating to a currently known object. In this embodiment and as before an object is scanned so that its characteristics may be determined. Scanning is carried out to obtain the optical photometric characteristics of the object using imaging and non-imaging sensor systems. As before the data obtained is stored and then transmitted to a remote location for analysis in a computer with the corresponding data of a preferred object whose data information is captured in a data base. After comparison and adding, where appropriate, suitable dialogue from an expert in that field, a regenerated signal is formed and transmitted back to the sender so that the sender has an expert assessment of the differences between the respective objects. A particular application in this embodiment is for component parts used in an assembly. The data information obtained relating to that part may be compared to a perfect component part whose data is stored at the remote location so that the differences may be assessed. This embodiment may also be employed for detecting, for example, faults in a particular component part.

It will be apparent that the latter embodiment may be applied to any suitable target of which analysis is required. The present invention, thus, provides a method and means for expertly teaching or instructing procedures, strategies, assessments or perceptions in audio-visual form to enable a viewer to more closely emulate, calculate or develop techniques suitable to their various applications.

While the above has been given by way of illustrative embodiments of the invention, all such modifications and variations thereto as would be apparent to persons skilled in the art are deemed to fall within the broad scope and ambit of the invention as herein defined by the appended claims.

I claim:

1. A method for providing an instructional aid for assisting a person to emulate a preferred movement, said method comprising:

capturing and storing initial visual image signals representative of a particular movement at a first location, storing preferred image signals representative of a selected preferred movement at a second location remote from said first location in a data base of a computer, transmitting said captured and stored visual image signals from said first location to said computer at said second location, comparing said captured and stored image signals with stored preferred image signals in said data base of said computer, regenerating further visual secondary image signals based on said initial image signals of said particular movement adjusted to emulate said stored preferred image signals of said selected movement in said computer, and transmitting said regenerated signals from said computer at said remote second location to said first location and stored in image presentation means which permits viewing thereof with dialogue relating to said regenerated visual secondary image signals.

2. A method according to claim 1, wherein said initial visual image signals of said particular movement are captured and stored using a video camera.

3. A method according to claim 1 wherein said transmitting comprises selecting an independent signal transmitter or a personal computer.

4. A method according to claim 1 wherein said transmitter transmits said image signals over a communication network to said computer.

5. A method according to claim 1 wherein bio-mechanical data relating to said regenerated images is displayed within an image presentation.

6. A method of providing an instructional aid relating to a location development recommendation, said method comprising the steps of:

capturing and storing initial visual image and location data signals of a proposed development proposal at a first location and transmitted to a second location remote from said first location, analyzing at said second location said initially captured signals against the stored visual image and location data signals of selectively one of a preferred known location development and a new design development stored in a data base of a computer, regenerating further secondary visual image and location data signals based on said initial signals of said proposed development adjusted in accordance with said visual image and data signals of selectively one of said preferred known location development and said new design development in said stored data base of said computer so as to provide a location development recommendation for said preferred development, and transmitting said location development recommendation from said computer back to said first location for analysis.

7. A method according to claim 6, wherein said visual image and data signals of said proposed development are captured and stored using a device selected from a video camera and a remote sensing device.

8. A method according to claim 6, wherein said transmitted regenerated image and data signals are provided in a format for subsequent home viewing.

9. A method according to claim 8, comprises the addition of dialogue to said format so as to provide an audio-visual presentation.

10. Apparatus for providing an instructional aid for emulation of a preferred movement, said apparatus comprising;

means for capturing visual image signals of a particular movement at a first location, means for storing said captured visual image signals at a second location remote from said first location, means for storing visual image signals of a plurality of preferred movements at said second location, means for comparing said captured visual image signals with the stored image signals of a selected one of said preferred movement at said second location, and means for regenerating further visual image signals of said particular movement adjusted in accordance with said selected preferred movement to instruct in emulating said selected preferred movement at said first location.

11. Apparatus according to claim 10, wherein said means for storing visual image signals of a plurality of referred movements comprises a computer data base and wherein said comparing and regenerating means comprises a computer associated with said computer data base.

12. Apparatus according to claim 11 comprising a transceiver means for transmitting to said computer said visual image signals of said particular movement and for receiving from said computer said regenerated visual images signals.

13. Apparatus according to claim 11, comprising means for converting said regenerated image signals into a format which allows viewing thereof.

14. Apparatus according to claim 13, comprising means for adding to said format dialogue relating to said regenerated images.

15. Apparatus according to claim 13, comprising means for adding to said format bio-mechanical data relating to said regenerated images.

16. Apparatus for providing an instructional aid based on a visual image of a particular location comprising:

means for visually scanning said location and for producing visual image signals representative of said location, means for storing said visual image signals, means for transmitting said visual image signals to a remote location, means for comparing said transmitted visual image signals with corresponding signals of a selected prestored image, means for regenerating further image signals comprising said image signals of said particular location adjusted in accordance with said selected pre-stored signals of said image, means for retransmitting said regenerated image signals, and converting said image signals into a format which enables viewing of said regenerated image signals of said particular location at said means for visually scanning the instructional aid.

17. Apparatus for providing a personalized instructional aid in a development presentation based upon a visual image signal of a particular location comprising:

means for visually scanning a particular location and for producing image and informational data signals representative of said particular location, means for storing said representative visual and informational data signals, means for transmitting said representative visual and informational data signals to a remote location, means at said remote location for comparing said representative visual and informational data signals with the signals of a selected pre-stored location and a structural procedure related to visual and informational data signals, means at said remote location for regenerating further visual data and informational signals based on said signals of said particular location adjusted in accordance with said pre-stored procedure signals to assist in said development, means at said remote location for adding dialogue and informational data to said regenerated signals, means for transmitting said regenerated image and informational data signals from said remote location, and converting said regenerated image and informational signals into a format which enables viewing to provide a personalized and instructional development presentation.

18. Apparatus for providing a personalized instructional aid based upon optical photometric characteristics of a particular target comprising:

means for visually scanning, sensing and capturing visual and informational data signals representative of a particular target, means for storing said representative visual and informational data signals, means for transmitting said representative visual and informational data signals to a remote location, means for comparing said representative visual and informational data signals with corresponding pre-stored signals of a selected target, means for regenerating further visual and informational data signals comprising said signals of said particular target adjusted in accordance with said pre-stored selected target signals, means for transmitting said further regenerated visual and informational data signals, and converting said further regenerated visual and informational data signals into a format which enables viewing to provide a personalized instructional aid.

19. Apparatus according to claim 18, wherein said regenerated format comprises further means for adding selectively one of dialogue and informational data to said regenerated format.

20. Apparatus according to claim 18, wherein said target scanning means comprises selectively one of an imaging sensor system and a non-imaging sensor system.

* * * * *